US005084090A

United States Patent [19]

Harker

[11] Patent Number: 5,084,090

[45] Date of Patent: Jan. 28, 1992

[54] VACUUM PROCESSING OF REACTIVE METAL

[75] Inventor: Howard R. Harker, Malvern, Pa.

[73] Assignee: Axel Johnson Metals, Inc., Lionville, Pa.

[21] Appl. No.: 555,913

[22] Filed: Jul. 19, 1990

[51] Int. Cl.[5] ..... C22B 4/00

[52] U.S. Cl. ..... 75/10.13; 75/10.19; 75/10.65; 373/12; 373/14; 373/74

[58] Field of Search ..... 75/10.13, 10.19, 10.65; 373/12, 14, 74

[56] References Cited

U.S. PATENT DOCUMENTS 2,734,244 2/1956 Herres ..... 75/10.13
2,932,588 4/1960 Frank ..... 75/10.13
3,101,515 8/1963 Hanks ..... 75/10.13
3,771,585 11/1973 Ulrich ..... 75/10.13
4,130,416 12/1978 Zaboronok ..... 75/10.19

*Primary Examiner*—Peter D. Rosenberg
*Attorney, Agent, or Firm*—Brumbaugh, Graves, Donohue & Raymond

[57] ABSTRACT

In the particular embodiments described in the specification, a vacuum furnace includes a conveying arrangement for holding four solid metal members with their end faces in closely-spaced relation and an energy beam gun directs energy to the adjacent faces to melt the metal. Metal ejected from the heated surfaces by explosive vaporization of inclusions in the metal is trapped by the adjacent surfaces of the other metal members.

10 Claims, 1 Drawing Sheet

VACUUM PROCESSING OF REACTIVE METAL

BACKGROUND OF THE INVENTION

This invention relates to improvements in vacuum processing of reactive metal, such as in an electron beam or plasma furnace, and to an improved furnace for use in such processing.

Certain reactive metals such as titanium, for example, are prepared by reduction of chlorides of the metals using sodium or magnesium to produce sponge metal. Such sponge metals, however, contain trapped sodium or magnesium chloride and, when heated in a vacuum such as in an electron beam or plasma furnace, the trapped chlorides vaporize in an explosive manner, spraying unmelted sponge particles throughout the interior of the furnace so as to reduce the yield and also contaminate material which has been refined in the furnace with unrefined particles. Similarly, scrap material resulting from the machining or other forming of such metals which has been compacted into a solid piece for processing may contain vaporizable impurities which produce the same effect.

One way of avoiding this problem is to use an inert gas plasma burner which operates at higher pressures, as described in the Ulrich U.S. Pat. No. 3,771,585, but this does not provide the advantages of an electron beam or plasma furnace operated at high vacuum. The Hanks U.S. Pat. No. 3,101,515 discloses an electron beam furnace with magnetically guided beams in order to avoid contamination of the electron beam source by sponge particles explosively ejected from the raw material, but that arrangement does not avoid the problem of lost material and contamination of the refined material. The Herres U.S. Pat. No. 2,734,244 discloses a vacuum arc refining furnace for titanium sponge which requires a separate chamber to vaporize and drive off volatile inclusions from the sponge material which might interfere with the refining process, after which the material is delivered to the refining furnace.

SUMMARY OF THE INVENTION

Accordingly, it is an object of the present invention to provide a new and improved process for vacuum refining metal materials which overcomes the above-mentioned disadvantages of the prior art.

Another object of the invention is to provide a vacuum furnace for processing reactive metals in an improved manner.

These and other objects of the invention are attained by supplying a metal member to be processed in a vacuum furnace by application of energy to an exposed surface of the metal member and providing one or more closely-spaced spray-intercepting surfaces to block unmelted material sprayed from the heated surface of the metal member from reaching other parts of the vacuum furnace. In one embodiment, one or more of the blocking surfaces is provided by one or more additional metal members to be processed. In this arrangement, the additional metal members have closely adjacent surfaces which are also heated by the application of energy and, preferably, an array of three or more metal members have adjacent surfaces substantially enclosing the region in which the metal is heated by the energy application.

In a typical vacuum furnace arranged for processing metal according to the invention, four metal members are supported with their end surfaces disposed in closely-spaced opposed relation and an energy source positioned above the region surrounded by the opposed surfaces supplies energy to all of the adjacent metal surfaces to melt the metal simultaneously and cause the molten metal to flow into a receptacle such as a trough or hearth beneath the region surrounded by the surfaces. Thus, substantially all of the solid metal particles sprayed from the heated surfaces by vaporized inclusions as the metal surfaces are heated is merely deposited on an adjacent metal surface for melting or else drops into the receptacle for molten material flowing from those surfaces.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
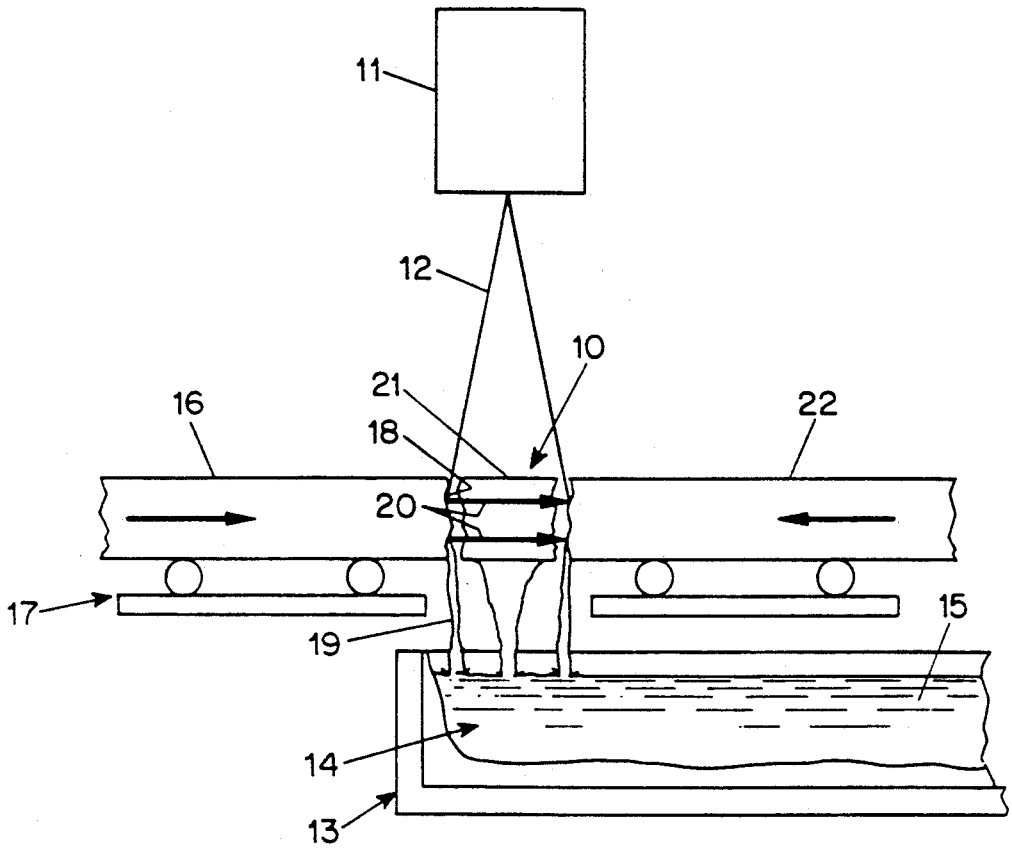
FIG. 1 is a schematic side view of the melting region of a representative embodiment of a vacuum furnace arranged in accordance with the invention.

In the representative embodiment of the invention shown in the drawings, the melting region 10 of a vacuum furnace, which may, for example, be an electron beam or plasma furnace having an evacuated enclosure (not shown) includes an electron beam or plasma gun 11 arranged in the usual manner to direct a beam of energy 12 in a controlled pattern to heat the metallic raw material to be melted and processed in the furnace. A hearth 13 arranged to receive the metallic material to be processed has a receiving portion 14 irradiated by the gun 11 for receiving molten metal to form a pool 15 which flows from the receiving portion toward a refining portion, not shown in the drawing, where the molten metal is refined and subsequently poured into a casting mold.

Solid metal such as titanium sponge which contains included vaporizable substances such as sodium or magnesium chloride as a result of the sponge formation process or compacted scrap metal containing vaporizable impurities in supplied to the furnace in the form of a solid member such as an electrode 16 and is fed toward the melting region 10 by a conveyor arrangement 17. Impingement of energy from the gun on the front surface 18 of the electrode 16 melts the material at the surface, producing a molten stream 19 which flows from the front surface into the hearth 13. Because the electrode contains vaporizable inclusions, heating of the surface 18 causes the vaporizable material to be vaporized rapidly and to eject solid or partially melted metal away from the surface 18 as indicated by the arrows 20.

Figure 2:
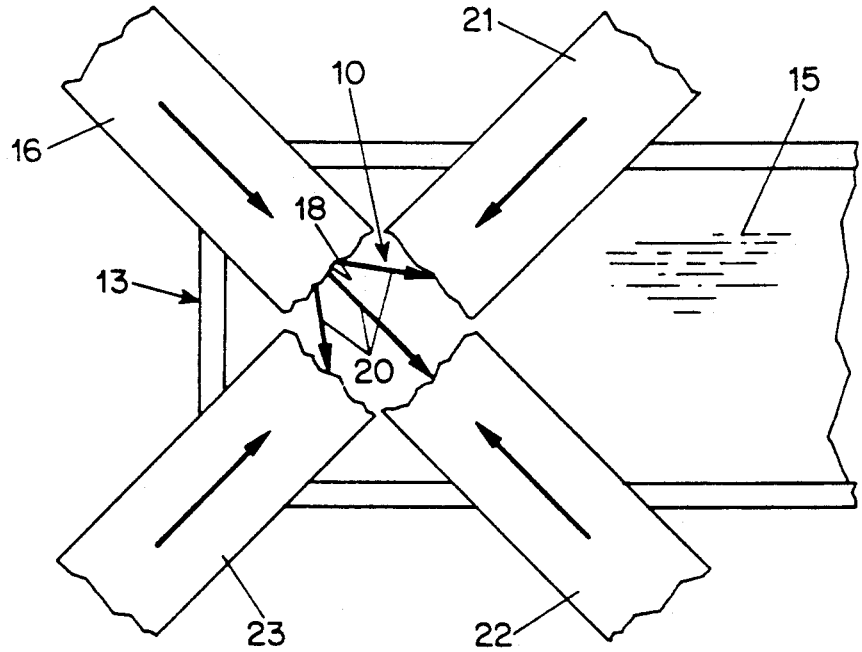
FIG. 2 is a schematic plan view of the region of the furnace shown in FIG. 1.

In accordance with the invention, the front surface 18 of the electrode 16 is substantially surrounded by closely adjacent surfaces which receive and trap the material ejected from the surface 18. In the illustrated embodiment, three additional metal electrodes 21, 22 and 23 are arranged as best seen in FIG. 2 to form an enclosed region adjacent to the surface 18 with the electrode 22 directly opposed to the electrode 16 and the electrodes 21 and 23 opposed to each other and at right angles to the electrodes 16 and 22. As indicated by the arrows, each of the electrodes is movable toward the melting region 10 as the end surfaces of the electrodes are melted. Preferably, the four electrodes are oriented at 45° to the longitudinal axis of the hearth 13, as shown in FIG. 2, to assure adequate access to the surface of the pool of molten metal 15 from another gun in the refining area (not shown).

In the illustrated embodiment, each of the additional electrodes 21, 22, and 23 is guided on a corresponding conveyor toward the region adjacent to the electrode 16 so that all four electrodes are continuously melted to supply material to the hearth 13 and substantially all of the solid material ejected by explosive vaporization from each of the adjacent surfaces impinges upon the surface of one of the other electrodes, where it is melted by the energy beam and flows into the hearth with the other molten material. Any material which is not melted on an adjacent electrode face or which falls directly into the pool 15 of molten material is melted by the energy beam 12 as it passes between the adjacent electrode surfaces and applies energy to the surface of the molten metal in the pool 15.

If desired, instead of having four electrodes 16, 21, 22 and 23, all movable on conveyors toward the melting region 10, the furnace may be arranged so that only one or two of the electrodes are fed toward the melting zone and the other adjacent surfaces are maintained stationary and only that material which accumulates on those surfaces is melted by the electron beam 12. With this arrangement, it is not necessary for the additional electrodes to have substantial length and the furnace structure is significantly simplified. While only four electrodes, all disposed in the same horizontal plane, are shown in the illustrated embodiment, it is also possible to provide more or fewer electrodes in a horizontal plane and to include further electrodes extending at an angle to a horizontal plane as long as the energy beam 12 has access to the adjacent surfaces of all of the electrodes to be melted and provision is made for molten material to flow from the electrodes into the hearth.

Although the invention has been described herein with reference to specific embodiments, many modifications and variations therein will readily occur to those skilled in the art. Accordingly, all such variations and modifications are included within the intended scope of the invention.

I claim:

1. A method for vacuum processing of metal containing vaporizable impurities comprising supplying metal to a vacuum furnace in the form of a member having a surface to be melted by energy impingement, providing at least one further surface at least partially opposed to the surface to be melted to receive metal particles ejected from the surface to be melted upon heating thereof by energy impingement, and directing an energy beam toward the surface of the member to be melted in a melting region to melt material at the surface.

2. A method according to claim 1 wherein opposed surface is the surface of another metal member to be melted.

3. A method according to claim 1 including providing a plurality of surfaces at least partially opposed to the end surface of the solid member to receive metal ejected therefrom.

4. A method according to claim 1 including moving the solid member toward the melting region as the surface thereof is melted by the energy beam.

5. A method according to claim 1 wherein the opposed surface is the end surface of a second metal member to be melted and including moving the second metal member toward the melting region as the end surface thereof if melted by the energy beam.

6. A method according to claim 1 including providing three further metal members having surfaces at least partially opposed to the surface of the metal member to be melted.

7. A method according to claim 6 including moving each of the further metal members toward the melting region as the surfaces thereof are melted.

8. A vacuum furnace for processing metal comprising energy gun means disposed to direct a beam of energy toward a melting region, conveyor means for guiding a metal member having an end surface toward the melting region to expose the end surface thereof to an energy beam from the energy gun, and confining means adjacent to the melting region providing at least one confining surface at least partially opposed to the end surface of a metal member conveyed by the conveyor means toward the melting region to receive metal ejected from the end surface of the metal member upon heating thereof.

9. A vacuum furnace according to claim 8 wherein the confining means comprises a plurality of metal members having surfaces at least partially opposed to the surface of the metal member being melted.

10. A vacuum furnace according to claim 9 including conveying means for conveying each of the plurality of metal members toward the melting region.

* * * * *

UNITED STATES PATENT AND TRADEMARK OFFICE

CERTIFICATE OF CORRECTION

PATENT NO. : 5,084,090

DATED : January 28, 1992

INVENTOR(S) : Howard R. Harker

It is certified that error appears in the above-identified patent and that said Letters Patent is hereby corrected as shown below:

Column 2, line 50, The word "gun" should read --gun 11--.

Column 4, line 8, The word "wherein" should read --wherein the--; line 23: The words "if melted" should read --is melted--.

Signed and Sealed this

Fourteenth Day of June, 1994

*Attest:*

*Attesting Officer*

Bruce Lehman

BRUCE LEHMAN

*Commissioner of Patents and Trademarks*